US006809467B2

(12) United States Patent
Boisson et al.

(10) Patent No.: US 6,809,467 B2
(45) Date of Patent: Oct. 26, 2004

(54) METHOD OF ASSEMBLING ELECTRON GUN ELECTRODES FOR A CATHODE-RAY TUBE

(75) Inventors: Jean-Marc Boisson, Ferrieres les Bois (FR); Florent Blot, Chamblanc (FR)

(73) Assignee: Thomson Licensing S. A., Boulogne-Billancourt (FR)

( * ) Notice: Subject to any disclaimer, the term of this patent is extended or adjusted under 35 U.S.C. 154(b) by 0 days.

(21) Appl. No.: 10/167,624

(22) Filed: Jun. 12, 2002

(65) Prior Publication Data

US 2003/0230964 A1 Dec. 18, 2003

(51) Int. Cl.[7] ..... H01J 29/50
(52) U.S. Cl. ..... 313/414; 313/238; 313/456
(58) Field of Search ..... 313/409, 438, 313/411–414, 451, 456, 243, 238

(56) References Cited

U.S. PATENT DOCUMENTS 4,605,880 A * 8/1986 McCandless et al. ..... 313/414
5,235,241 A * 8/1993 Van Eck et al. ..... 313/414
5,841,224 A * 11/1998 Kim et al. ..... 313/412

* cited by examiner

*Primary Examiner*—Ashok Patel
(74) *Attorney, Agent, or Firm*—Joseph S. Tripoli; Harvey D. Fried; Richard LaPeruta, Jr.

(57) ABSTRACT

The method of assembling an electron gun for a cathode-ray tube comprises the steps loading of at least two electrodes (20, 70) one above the other, adjusting the distance between the electrodes along the longitudinal axis of the gun, and loading the electrodes between the two jaws (30, 30', 31, 31', 60, 60', 61, 61') of a positioning tool (35). The further includes positioning of the electrodes in the plane perpendicular to the longitudinal axis by clamping the jaws of the tool in a single direction, until a pressure is exerted on four corners (23) of each electrode and retaining by hot insertion of glass beads (40) into claws arranged on the periphery of the electrode openings of the positioning tool. The tool holds the electrodes in planes perpendicular to the longitudinal axis of the gun. The jaws have a profile intended to cooperate with the shape of the corners of the electrodes in such a way that upon closure of the jaws, the electrodes are brought to their nominal position in the plane perpendicular to the longitudinal axis.

7 Claims, 3 Drawing Sheets

METHOD OF ASSEMBLING ELECTRON GUN ELECTRODES FOR A CATHODE-RAY TUBE

FIELD OF INVENTION

The subject of the invention is a method of assembling the electrodes of an electron gun for a cathode-ray tube and, more particularly, electrode shapes which allow the implementation of the process. The invention is particularly adapted to electron guns for cathode-ray tubes with improved resolution.

BACKGROUND OF INVENTION

An electron gun takes the form of a succession of electrodes drilled with one or more openings for the passage of the electron beans intended to form an image on the screen of the tube in which the gun is inserted. On their peripheral surface, these electrodes generally possess metal claws which will be inserted, hot, into glass beads intended to keep the stack of electrodes constituting the gun in place. The openings located on two facing electrodes constitute electron lenses intended to act on the trajectory or the shape of the electron beams passing through them. The relative positioning of the openings of the electrodes is therefore extremely critical and must be performed with great accuracy. The openings of the various electrodes have long been circular and concentric, so that the gun needed to be assembled by stacking the electrodes one above another, cylindrical rods passing through the openings automatically positioning these openings with respect to one another.

Present-day electron guns are required to provide even finer supervision of the trajectory and the shape of the electron beams, this leading to the design of ever more complex electrostatic lenses. This complexity is manifested by the fact that the openings of the electrodes often have shapes which are far removed from the previous circular shapes, and that the openings of two successive electrodes are no longer coaxial as in the past. As a result, the methods of assembly of the prior art and in particular the methods of relative positioning of the openings by virtue of rods passing through them are no longer applicable.

SUMMARY OF INVENTION

The invention is a method of assembly which is a convenient and efficient. The method does not utilize the openings of the electrode themselves as the reference positions, but rather relies on the shape of the periphery of the electrodes for alignment.

Accordingly, the method of assembling an electron gun for a cathode-ray tube according to the invention is characterized in that it comprises the following steps:

loading of at least two electrodes one above the other;

adjusting the distance between the electrodes along the longitudinal axis of the gun, for example, by use of wedges of given thickness arranged between the electrodes;

loading the electrodes between the two jaws of a positioning tool;

relatively positioning of the electrodes in the plane perpendicular to the longitudinal axis by clamping the jaws of the tool in a single direction, until a pressure is exerted on the four corners of each electrode;

final retentioning by hot insertion of glass beads into claws arranged on the periphery of the electrode openings of the positioning tool.

The tool for positioning electron gun electrodes for implementing the invention is characterized in that, in the plane perpendicular to the longitudinal axis of the gun, the jaws have a profile intended to cooperate with the shape of the corners of the electrodes in such a way that upon closure of the jaws, the electrodes are brought to their nominal position in the plane perpendicular to the longitudinal axis.

BRIEF DESCRIPTION OF THE DRAWINGS

The invention, as well as its advantages, will be better understood with the aid of the following description and the drawings.

DETAILED DESCRIPTION OF THE INVENTION

Figure 1:
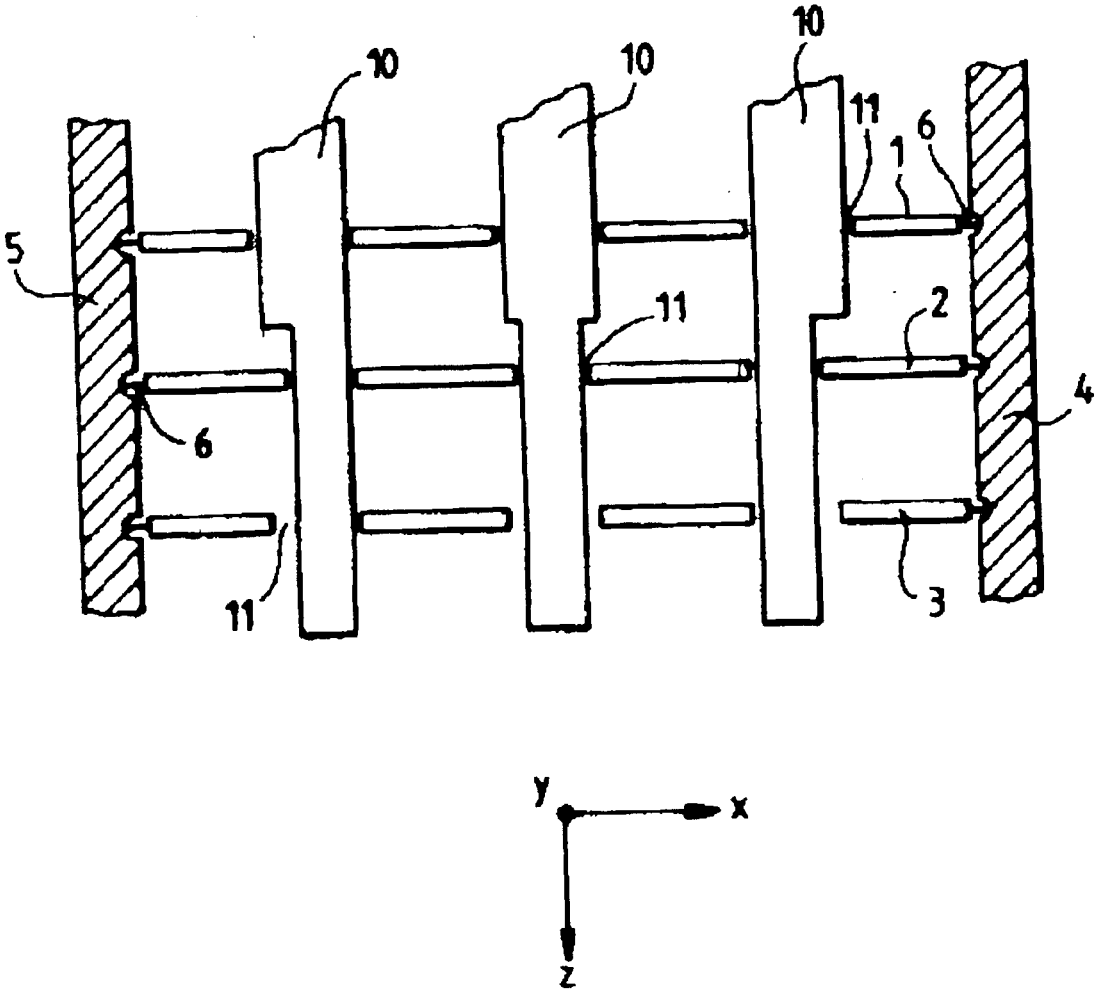
FIG. 1 illustrates a mode of assembly according to the prior art.

As illustrated by FIG. 1, an electron gun generally consists of a stack of electrodes arranged in succession along a longitudinal axis Z, coinciding with the longitudinal axis of the tube in which the gun is subsequently secured.

The electrodes are drilled with openings 11 for the passage of the electron beam or beams generated in the bottom part of the gun by one or more cathodes. The electrodes are connected to different potentials, the openings 11 of an electrode forming together with the corresponding openings of the next electrode, electrostatic lenses charged with modifying the trajectory of the beams and the shape of the beams. The positioning of the electrodes is therefore essential to ensure the optimal operation of the gun.

The positioning along the longitudinal axis Z is, in a generally known manner, performed by inserting wedges of accurately controlled thickness between the electrodes. The positioning of the openings of the electrodes in the plane perpendicular to the longitudinal axis is more complex to perform, according to a known method, illustrated by FIG. 1, wherein the position of the openings is effected by stacking the components on mandrels 10 passing through the openings and coming into contact with them at at least one part of their periphery. Once the electrodes are in position, they are finally immobilized with respect to one another by virtue of claws 6 arranged on the periphery of the electrodes and which will be inserted into glass beads 5 raised to high temperature. The wedges which adjust the position in the Z direction are removed at this point in time.

However, this method has limitations: for one and the 20 same electron beam, the positions and the shapes of the openings on several successive electrodes are limited by the fact that they must come into contact with a mandrel passing through all of these successive openings. Moreover, the trend requires the electron beams to strike the screen with a homogeneous and controlled shape over the whole surface of the screen. Electrostatic lenses are more and more complex, and in order to make them, the designer must be free to position the openings just where necessary, while giving these openings complex shapes so as to obtain the desired result.

The invention proposes a method of positioning the electrodes with respect to one another without using mandrels passing through the openings of the electrodes. This method can be implemented by virtue of a positioning tool adapted to the peripheral profile of the electrodes.

Figure 2A:
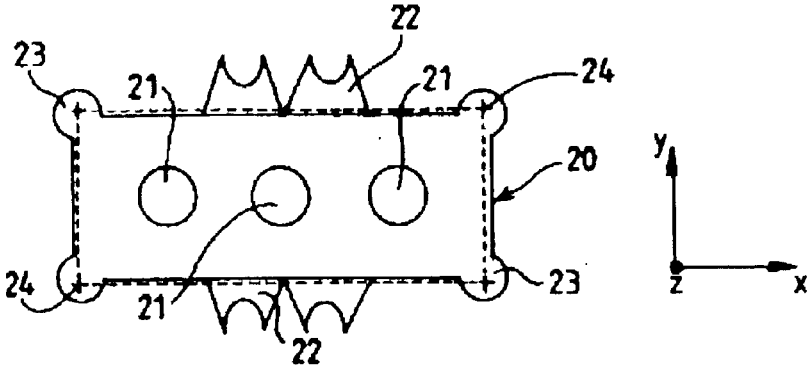
FIGS. 2A and 2B illustrate an embodiment of an electrode and of an assembly tool allowing assembly according to the invention.

An exemplary embodiment of an electrode for implementing the process according to the invention is illustrated by FIG. 2A. The electrode 20 has, in the plane perpendicular to the longitudinal axis of the gun, a periphery of substantially rectangular shape. The electrode is drilled with openings 21 for the passages of the three electron beams generated by the three cathodes placed in the bottom part of the electron gun. Arranged on the long sides of the periphery of the electrode are claws 22 intended to be inserted into glass beads intended for retaining the electrodes in position. According to the invention, the electrode 20 possesses at least two corners 23 of rounded shape placed outside the fictitious rectangle formed by the sides of the periphery of the electrode. In the nonlimiting example of FIG. 2A, the electrode possesses four identical corners for reasons of ease of manufacture, these corners have a substantially circular shape whose centers lie outside the rectangle formed by the long and short sides of the electrode. In this way a large part of the rounded surface of the corners is offset outwards with respect to the fictitious corners of the rectangle formed by the long and short sides of the electrode.

Figure 2B:
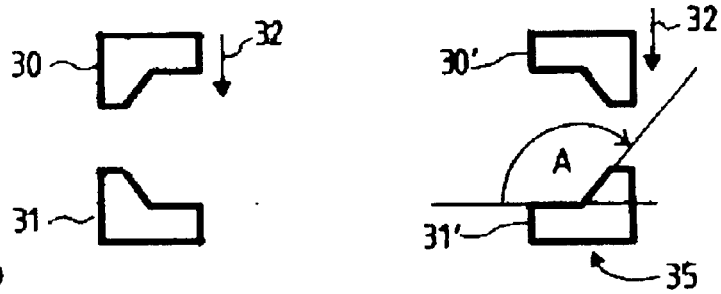

FIG. 2B is an embodiment of the tool 35 for positioning the electrodes illustrated by FIG. 2A. This tool being seen in a section of the plane perpendicular to what is be the longitudinal axis Z of the gun.

The tool possesses two jaws 30, 30', 31, 31', each jaw being composed of two parts secured together, two jaws 30, 30' on one side, two jaws 31 31' on the other side. The jaws 30, 30', 31, 31' have an internal profile intended to come into contact with the corners of the electrodes of the gun through a translational movement in a single direction. The two sets of jaws 30, 30', 31, 31' may be movable. With the aim of economizing on means, one jaw may be immovable and the other jaw movable in a single direction 32 as illustrated by FIG. 2B.

Figure 3:
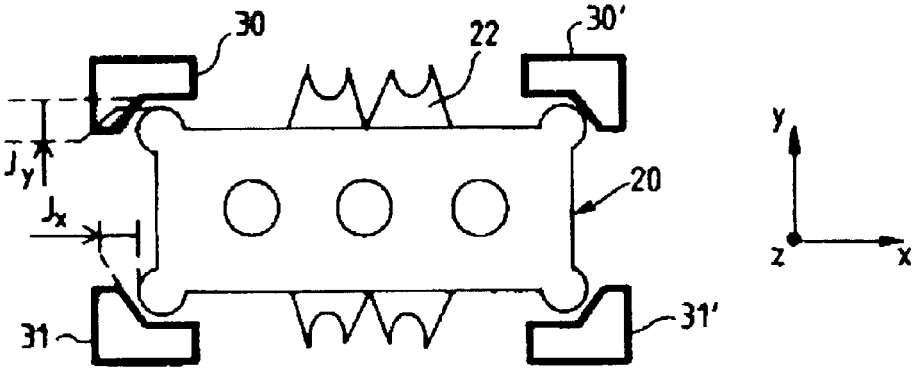
FIGS. 3 and 4 illustrate a mode of carrying out the invention.
Figure 4:
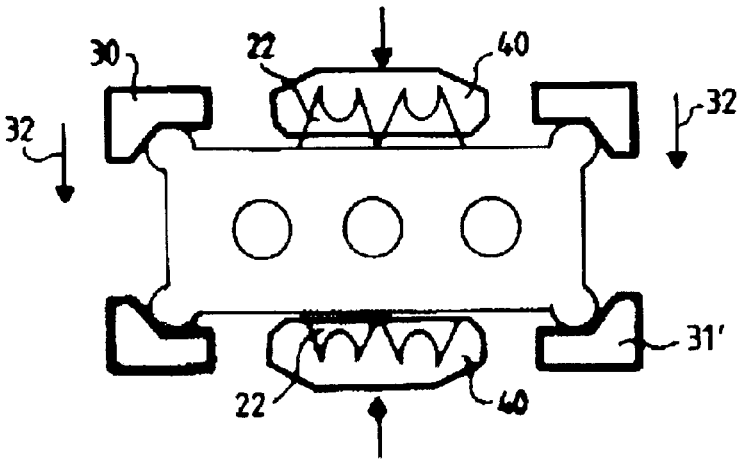

By virtue of the tool 35, the method of assembling the electrodes 20 of the gun is performed in the manner illustrated by FIGS. 3 and 4. The electrodes 20 are stacked above one another and their reciprocal distance along the longitudinal axis is fixed by wedges. The electrodes and their wedges are arranged inside the positioning tool 35 in which the electrodes possess mechanical play Jx and Jy in the plane perpendicular to the longitudinal axis Z.

The jaws of the tool 35 are closed through a translational movement in a single direction, y, until the internal profiles of the jaws exert a pressure on the four corners of the electrodes; the internal profiles of the tool 35 are adapted to the shape of the corners of the electrodes 20 in such a way that these profiles automatically and accurately position the electrodes by firstly coming into contact with the corners and by pushing these corners back until they are pressed into the plane of the corners.

On each side of the electrodes, preferably on the longest side, glass beads 40, raised to a temperature close to melting, cover over the claws 22 arranged on the periphery of the electrodes. Since these beads extend in the longitudinal direction, they ensure the rigidity of the assembly of the constituent electrodes of the gun, and the rigid positional retention of the electrodes with respect to one another.

Once the beads 40 have returned to ambient temperature, the tool 35 is opened to release the assembly and the wedges between the electrodes are removed in a conventional manner.

Figure 5:
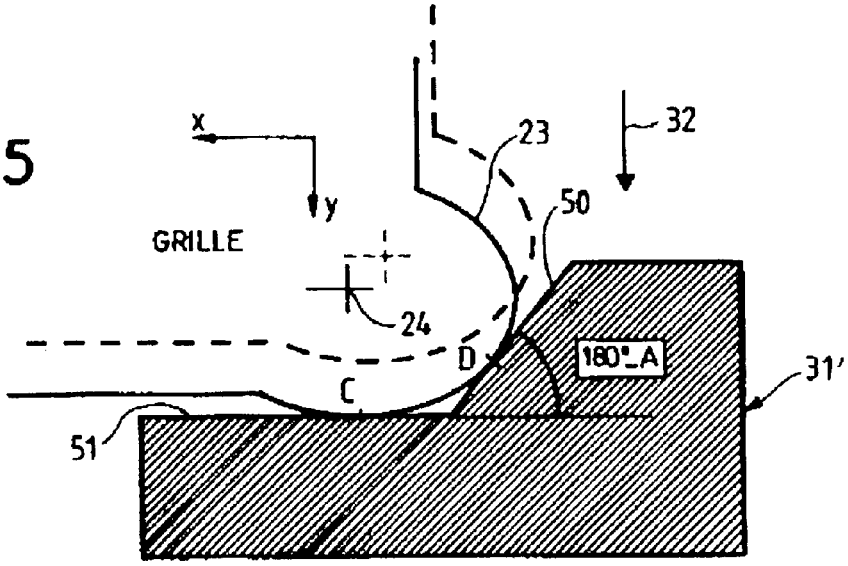
FIG. 5 illustrates a second mode of carrying out the invention.

The positioning of the electrodes inside the tool 35 is more accurately illustrated by FIG. 5. The initial position of the corner 23, when the tool 35 is open, is shown by the dashed curve and the final position as a solid curve.

The internal profile of the jaw parts coming into contact with the rounded corners of the electrodes is V-shaped, a first side 50 and a second side 51 of which form an obtuse angle A, one of the sides of the angle being substantially perpendicular to the direction Y of translation of the jaws. When the tool 35 is closed through a translational movement of the movable jaw (30, 30') in a single direction 32, the latter will come into contact with the corners of the electrode and push the electrode back against the internal profile of the fixed Jaw. The rounded corners of the electrodes will slide over the inclined planes defined by the first side 50, so as to contact the two sides of the V profile and the jaws will then exert a pressure on all the corners of the electrodes. The cooperation between the obtuse angle A of the internal profile of the jaws of the positioning tool 35 and the rounded shape of the corners of the electrode will make it possible to take up the mechanical play Jx and Jy and bring the electrodes into predetermined positions with respect to one another.

Figure 6:
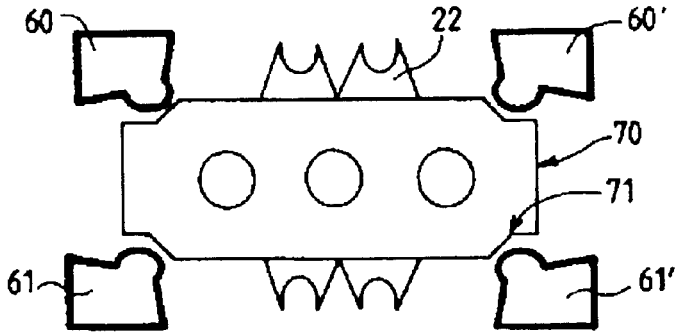
FIGS. 6 and 7 show the manner in which the second mode of assembly according to the invention is implemented.
Figure 7:
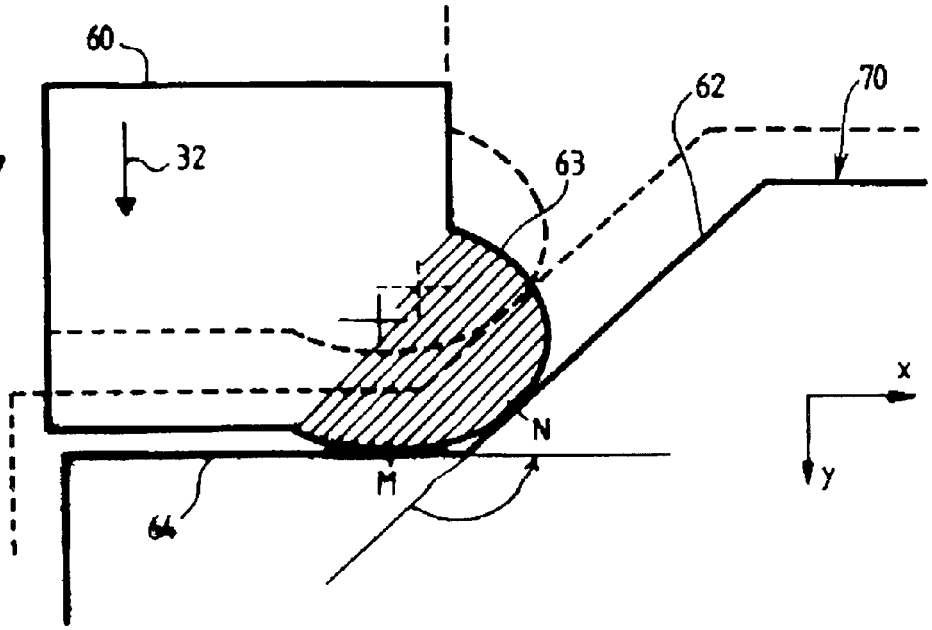

FIGS. 5 to 7 illustrate a second embodiment of the invention. The method of assembly remains the same, the mechanical play in the tool 35 being taken up by virtue of the cooperation between shapes complementary to the shapes of the first embodiment. In this case, the electrodes 70 possess at least two re-entrant corners each producing a V-shaped cutout 71. The first cutout side 62 and the second cutout side 64 form an obtuse angle with the second cutout side 64 of the V being substantially perpendicular to the single direction 32 of the movable jaw.

The first two jaws 60, 60' are movable by translation in a single direction with respect to the second two jaws 61, 61'. The internal profile of the jaws is such that the parts 63 coming into contact with the V cutouts of the corners of the electrodes have a rounded shape when the first two jaws 60, 60' push the electrodes 70 back against the fixed second two jaws 61, 61'. The pressure exerted by the rounded shape of part 63 on the inclined plane consisting of the first cutout side 62 of the cutout will cause the electrodes to slide until the mechanical play Jx and Jy is taken up. With this being achieved when the rounded shape of part 63 contacts the first and second cutout sides 62, 64 at two points M, N.

The invention can be implemented with electrodes possessing two corners with cutouts and two corners whose sides are at right angles.

It is preferred have the electrodes 70 with symmetrical corners with respect to two axes of symmetry parallel to the X and Y axes as illustrated by FIGS. 3 and 6. These shapes afford more accurate positioning of the electrodes as well as other advantages such as the fact of not having to orient the electrodes when presenting them to the positioning tool 35.

What is claimed is:

1. Electrode for an electron gun for a cathode-ray tube, having at least one hole therethrough for the passage of at least one electron beam, the electrode having a substantially rectangular plane peripheral zone contained in a plane perpendicular to the longitudinal axis of the gun and by sides of the electrode at least one pair of cutouts being disposed at at least two corners of the peripheral zone and the cutouts being defined by two sides of the cutout forming an obtuse angle, wherein the sides of the at least one pair of cutouts are aligned to orient and position the at least one hole when a clamping forces is applied to the pair of cutouts.

2. Electrode according to claim 1, wherein the electrode has two perpendicular axes of symmetry.

3. Electrode for an electron gun for a cathode-ray tube, having one or more holes for the passage of at least one electron beam, the electrode comprising a substantially rectangular peripheral zone contained in a plane perpendicular to the longitudinal axis of the gun, wherein at least two successive corners of the peripheral zone have a rounded shape lying outside the rectangular peripheral zone to orient and position the at least one hole when a clamping force is applied therebetween.

4. Electrode according to claim 3, wherein the electrode has two perpendicular axes of symmetry.

5. Cathode-ray tube comprising a gun with at least two electrodes each having at least one hole for the passage of at least one electron beam, the electrodes having a substantially rectangular peripheral zone contained in a plane perpendicular to the longitudinal axis of the gun and defined by sides of the electrode, at least one pair of cutouts being disposed at two or more corners of the peripheral zone, the cutouts being defined by two sides of the cutout forming an obtuse angle, the sides of the at least one pair of cutouts being aligned to orient and position the at least one holes from the at least two electrodes when a clamping force is applied between the pairs of cutouts.

6. Cathode-ray tube comprising a gun with at least two electrodes, each having one or more holes for the passage of at least one electron beam, the electrode comprising a substantially rectangular peripheral zone contained in a plane perpendicular to the longitudinal axis of the gun, wherein at least two successive corners of the peripheral zone have a rounded shape lying outside the rectangular peripheral zone to orient and position the at least one hole when a clamping force is applied therebetween.

7. A cathode ray tube having a gun with electrode comprising:

a substantially rectangular peripheral zone contained in a plane perpendicular to the longitudinal axis of the gun;

a plurality of in-line holes within the rectangular peripheral zone and extending through the electrode for the passage of electron beams with an axis of symmetry passing through the plurality of holes; and at least one pair of positioning structures disposed at consecutive corners of the rectangular peripheral zone and configured as a rounded structure or an obtuse cutout to position and orient the electrode by interaction with the other of a rounded structure and an obtuse cutout when clamping force is applied at the pair positioning structures in a direction perpendicular to the axis of symmetry.

* * * * *